United States Patent [19]

Krambeck et al.

[11] Patent Number: 4,606,810

[45] Date of Patent: Aug. 19, 1986

[54] FCC PROCESSING SCHEME WITH MULTIPLE RISERS

[75] Inventors: Frederick J. Krambeck, Cherry Hill, N.J.; Carmo J. Pereira, Columbia, Md.

[73] Assignee: Mobil Oil Corporation, New York, N.Y.

[21] Appl. No.: 721,338

[22] Filed: Apr. 8, 1985

[51] Int. Cl.[4] ..... C10G 51/02

[52] U.S. Cl. ..... 208/74; 208/76; 208/113; 208/155; 208/160; 208/164

[58] Field of Search ..... 208/74, 155, 164, 113, 208/76, 72, 73, 160

[56] References Cited

U.S. PATENT DOCUMENTS

| | | | |
|---|---|---|---|
| 2,915,457 | 12/1959 | Abott et al. | 208/74 |
| 2,921,014 | 1/1960 | Marshall | 208/74 |
| 2,956,003 | 10/1960 | Marshall et al. | 208/74 |
| 3,748,251 | 7/1973 | Demmel et al. | 208/74 |
| 3,791,962 | 2/1974 | Demmel et al. | 208/80 |
| 3,849,291 | 11/1974 | Owen | 208/78 |
| 3,856,659 | 12/1974 | Owen | 208/80 |
| 3,894,932 | 7/1975 | Owen | 208/74 |
| 3,894,933 | 7/1975 | Owen et al. | 208/74 |
| 3,894,934 | 7/1975 | Owen et al. | 208/78 |
| 3,894,935 | 7/1975 | Owen | 208/164 |
| 3,907,663 | 9/1975 | Owen | 208/70 |
| 3,926,778 | 12/1975 | Owen et al. | 208/74 |
| 4,026,789 | 5/1977 | James | 208/74 |
| 4,312,743 | 1/1982 | Tu et al. | 208/74 |
| 4,424,116 | 1/1984 | Hettinger, Jr. | 208/113 |
| 4,436,613 | 3/1984 | Sayles et al. | 208/155 |

*Primary Examiner*—Andrew H. Metz
*Assistant Examiner*—Anthony McFarlane
*Attorney, Agent, or Firm*—Alexander J. McKillop; Michael G. Gilman; Dennis P. Santini

[57] ABSTRACT

A novel FCC method and apparatus, wherein a fresh hydrocarbon feed of relatively poor crackability is fed to one riser of a two riser system. The spent catalyst from the other of the two risers is fed to the inlet of the first riser to produce relatively mild cracking conditions. Improved total gasoline plus distillate yields are achieved. The novel two riser system facilitates heat balancing of the system.

4 Claims, 3 Drawing Figures

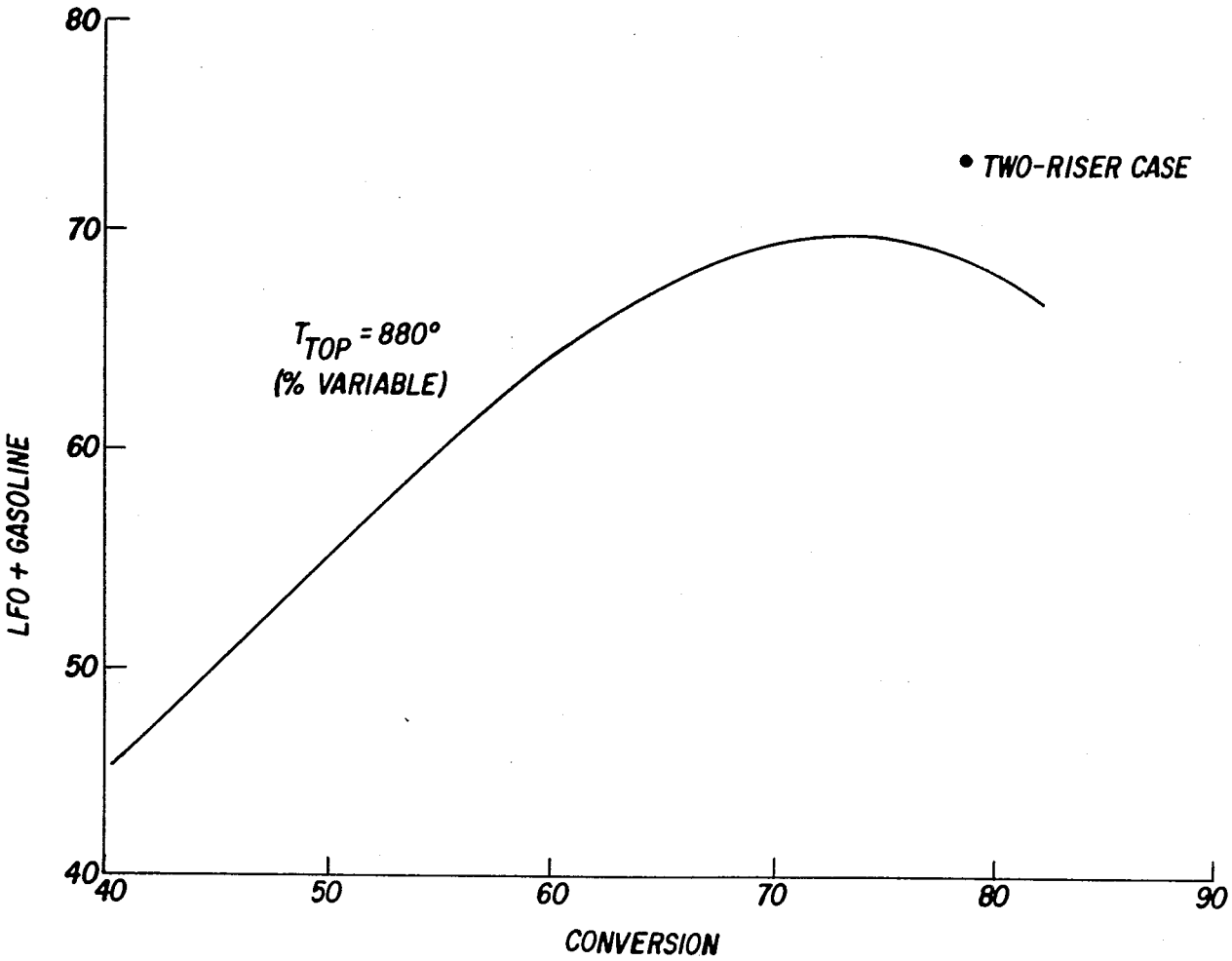
FIG. 3 WOERTH FEED: COMPARISON OF SINGLE RISER AND INVENTION SYSTEM

FCC PROCESSING SCHEME WITH MULTIPLE RISERS

BACKGROUND OF THE INVENTION

1. Field of the Invention

The role of catalytic cracking in fluidized and moving bed systems is well known at this stage of the art, having undergone progressive development since early 1940. Until recent years catalytic cracking operations have been forced to use a silica-alumina cracking catalyst which, by today's standards, is considerably less active and particularly is considered less selective for performing the catalytic cracking of the hydrocarbon charge to produce gasoline product. Thus, considerable difficulty has been encountered in the prior systems in obtaining high yields of conversion products without excess production of the carbonaceous contaminants.

The present trend in catalytic cracking operations is concerned with those systems which will use more active and selective cracking catalysts, such as those comprising crystalline zeolites, for performing the conversion of one or more high boiling hydrocarbon fractions of the same or different boiling range and coke producing characteristics to gasoline boiling range products. Thus, crystalline zeolite cracking technology necessarily requires using much more sophisticated cracking systems than those known or disclosed in the prior art in order to take full advantage of the catalyst's conversion capabilities. Many prior art systems and those converted for the use of high activity crystalline zeolite cracking catalysts have produced an inefficient operation, causing undue catalyst regeneration, excessive recycle of unconverted charge and general inefficient use of the catalyst composition.

The invention defined herein is concerned with an improved apparatus and sequence of conversion steps which will more efficiently utilize the capabilities of a crystalline zeolite cracking catalyst of high activity and high selectivity.

2. Description of the Prior Art

Fluid catalyzed cracking systems and zeolite cracking catalysts are well known in the art and are disclosed in many U.S. patents, including U.S. Pat. Nos. 3,748,251; 3,791,962; 3,849,291; 3,856,659; 3,894,933; 3,894,943; 3,894,935; 3,907,663; and 3,926,778, all of which are incorporated by reference.

SUMMARY OF THE INVENTION

The instant invention is a method for converting hydrocarbons to gasoline in a two riser system, comprising contacting fresh hydrocarbon feed of relatively poor crackability in a first riser with spent catalyst from a second riser; withdrawing the product from said first riser to separate the gasoline and distillate fraction from the high boiling point material; regenerating the coked catalyst from the first riser; feeding the higher boiling point material to said second riser; feeding the regenerated catalyst to said second riser to further convert the high boiling point material into gasoline; and separating the spent catalyst from said second riser and feeding it to said first riser.

This invention also proposes a method of cracking hydrocarbons in a two riser system, wherein products are formed in one riser from the contact of a fresh hydrocarbon feed of poor crackability with a catalyst, the improvement comprising feeding a spent catalyst to said one riser.

The invention further comprises an apparatus including a two riser system for the cracking of hydrocarbons by contact with a catalyst, comprising two risers, each of said risers being vertically mounted with a top and bottom, means for introduction of a hydrocarbon feed and a catalyst at said bottom of each riser, means to separate products from catalyst at said top of each riser, means to regenerate catalyst, means to feed said separated catalyst from a first riser of said two risers to said regenerating means, and means to feed said separated catalyst from the other of said two risers to the means for introduction of said first riser.

DESCRIPTION OF THE PREFERRED EMBODIMENTS

As has heretofore been stated, the novel apparatus and process of this invention is concerned with an improved sequence of conversion steps which will more efficiently utilize the capabilities of a crystalline zeolite cracking catalyst of high activity and high selectivity. The invention utilizes a dual riser system that is capable of producing higher yields of gasoline and light fuel oil at the expense of heavy oil. In the method and system of this invention, the contact time between catalyst and hydrocarbon varies with the hydrocarbon charge passed through the selective cracking operation. Generally, the cracking operation affected in a dispersed catalyst phase relation zone is restricted to orders of magnitude amounting from only a few seconds up to about 15 seconds and, in most instances, the contact time will be restricted depending on the composition of the hydrocarbon charge within the range of 4–12 seconds. Thus, the concepts essential to practicing the present invention includes the method and sequence of catalyst cascade, which will permit employing cracking temperatures in the range of 880° to about 1300° F. at a number of different catalyst-to-oil ratios and contact times herein identified. Further salient features of the present invention include the use of low coke producing catalyst in the riser reactors, desired catalyst-oil suspension relationships in a relatively low catalyst inventory system, and maximizing the use of heat available in the system to effect the catalytic conversion desired.

The utilization of highly selective low coke providing catalyst compositions comprising selected crystalline aluminosilicate catalyst compositions particularly suitable for accomplishing the processing concept are herein discussed. The processing concepts of this invention include a restricted contact time between a suspension of high activity catalyst and hydrocarbon feed being converted before discharge of the suspension into suitable separation equipment. Separation equipment particularly suitable for this purpose comprises one or more cyclone separators at the discharge end of each riser, which will minimize the time for separating catalyst particles in hydrocarbon material without substantially cooling upon discharge from the riser cracking zone.

In distinction to other prior art methods and systems, the present invention provides that a fresh feed of hydrocarbons of relatively poor crackability, such as shale oil, coker heavy gas oil, resid or low hydrocarbon-to-coke ratio or other poorly crackable stock, will be supplied to the inlet of a first riser, together with spent catalyst from a second riser. We have surprisingly found that when the fresh feed meets spent catalyst, conversion of the feedstock is low but selectivity to gasoline is high. The catalyst is separated from the products of the first riser by apparatus such as one or more cyclone separators, as previously described, and the coked catalyst is sent to a regenerator while the products are taken to a distillation apparatus. The heavy fuel oil fraction, together with the freshly regenerated catalyst, are both fed to the inlet of a second riser. The separation of the gasoline and light fuel oil by distillation from the product of the first riser, and the recycle of only the heavy fuel oil to the inlet of the second riser, prevents the distillate range material from further degradation. The cracking conditions in the second riser are much more severe than in the first riser, in that there is a relatively high catalyst-to-oil ratio, the catalyst has been freshly regenerated and at a higher temperature and, accordingly, there is a higher conversion in the second riser. The terms "first riser" and "second riser" are merely exemplary, and are not to be construed as limiting the invention.

As in the first riser, the catalyst products of the second riser are separated in one or more apparatus, such as a cyclone separator, with the difference that while the products from the second riser are sent to the distillation apparatus, the spent catalyst from the second riser is fed directly or indirectly to the inlet of the first riser together with the previously described fresh hydrocarbon feed. The spent catalyst from the second riser may be supplemented prior, during or subsequent to entering the inlet of the first riser with additional catalyst which has been regenerated. The spent catalyst from the second riser may be fed directly to the inlet of the first riser or may be temporarily stored in suitable holding tanks, well known in the art, or may be fed to means to mix the spent catalyst with a proportion of regenerated catalyst prior to being fed to the inlet of the first riser. Of course, the spent and regenerated catalyst may be separately fed from different sources to the inlet of the first riser, where they are mixed with the fresh hydrocarbon feed previously described.

The multiple riser system of the present invention offers flexibility with regard to heat exchange between various catalyst and liquid streams. Thus, for example, hot catalyst from the regenerator can be used to exchange heat with the spent catalyst from the second riser, which normally operates at a higher top temperature than the first riser, so that a higher top temperature can be reached for the first riser. As an example, consider a two riser system, with each riser operating at a top temperature at 960° F. This would mean that heat would have to be exchanged between the spent catalyst (at about 960° F., the top temperature of the second riser) from the second riser and the freshly regenerated catalyst (typically about 1300° F.), and between the products of cracking from each of the first and second risers and the fresh feed of poor crackability to the first riser. The present system would permit such heat transfer. The facile heat exchange of the present invention permits heat balancing of the system, and hence a control of cracking conditions, which would not be possible using prior art FCC apparatus or process, e.g., a single riser with multistage feed. This is a surprising development in view of the advantages of the present invention, such as lower capital cost of the two riser system over single riser systems, the production of higher gasoline and distillate yields and controlled heat balance of the present system.

It is generally preferred to accomplish cracking in an upflowing riser conversion zone discharging into an enlarged separation zone or cyclonic separating means housed in a larger zone, as previously described.

The two riser system of the present invention can process feedstock of poor crackability or with high aromatic content and basic nitrogen contents, such as coke or heavy gas oil and shale oil. The role of the first riser is then to relieve the feed of nitrogen/aromatics on the coke formed in this riser, and make the heavy product more processable in the second riser. In shale oil processing, the first riser can be used to remove nitrogen and used as an alternative to hydroprocessing.

Since the light fuel oil (LFO) is also separated from the product of the first riser and not allowed to crack further, the LFO+G (gasoline) yield in the two riser system is higher. Excess light fuel oil production at a fixed conversion is achieved at the expense of a heavy fuel oil (HFO) available in the feed. It can thus be seen that the invention herein provides an improved sequence of conversion steps, which utilizes more efficiently the capabilities of a crystalline zeolite cracking catalyst of high activity and high selectivity to produce higher LFO+G yields. The present invention also produces gasoline having higher octane in the first riser than would be achieved if more severe cracking conditions were imposed upon the feedstock. Hence, the selectivity of the spent catalyst from the second riser is used to advantage in the first riser in improving the gasoline yield through improved selectivity, although the conversion rate is expectedly lower than achieved by the regenerated catalyst used under the more severe conditions in the second riser.

BRIEF DESCRIPTION OF THE DRAWINGS

The invention will be better understood with reference to the examples which follow and with reference to the following figures, in which:

FIG. 3 is a comparison of the two riser system of the present invention with a single riser system of the prior art.

DESCRIPTION OF THE INVENTION

Figure 1:
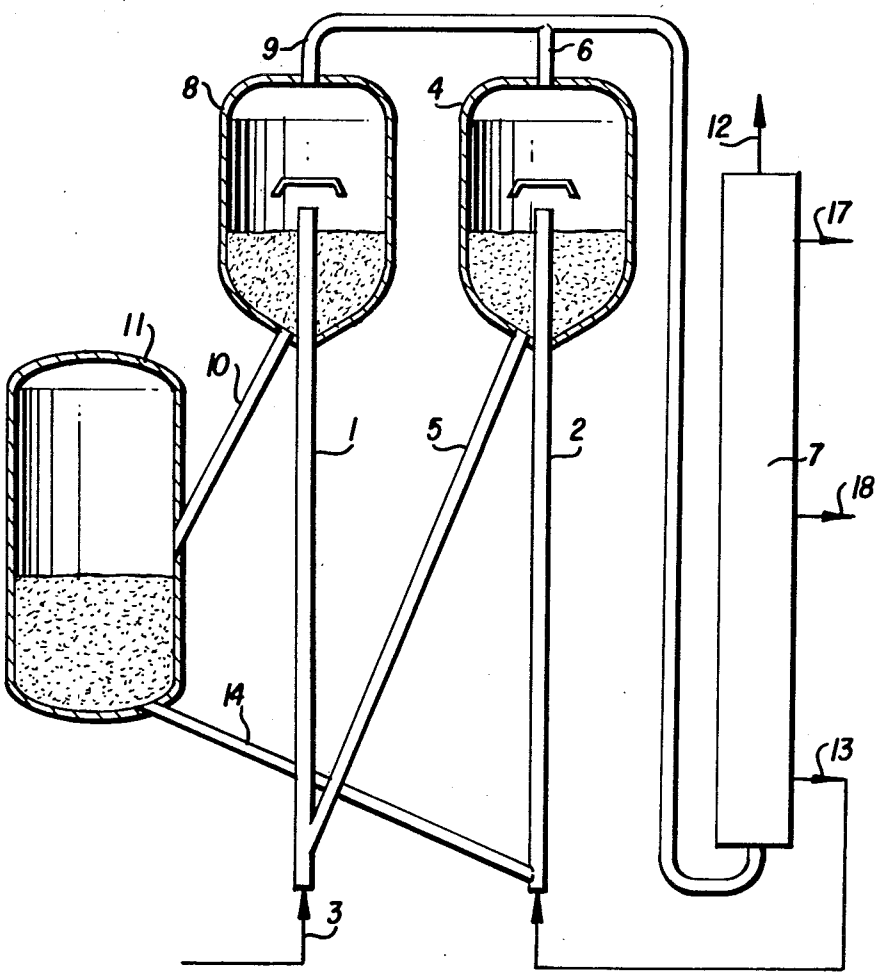
FIG. 1 is a schematic representation of a two riser system of the present invention, including the means to regenerate the catalyst as well as to distill the products from each of risers 1 and 2.

Referring now to the drawings, a fluidized catalytic cracking (FCC), two riser system is schematically shown in FIG. 1. Element 1 has been termed riser 1 and element 2 has been termed riser 2. This terminology is arbitrary and merely for illustrative purposes. Fresh hydrocarbon feed of poor crackability enters riser 1 typically at the bottom thereof through line 3. Spent catalyst, separated by apparatus such as cyclone separator 4, is fed through conduit 5 to the inlet of riser 1. It is understood that at least one additional cyclone separator (not shown) may be used in combination with cyclone separator 4 to effect the separation of the spent catalyst and products from riser 2. This spent catalyst acts with the hydrocarbon feed under relatively mild cracking conditions to produce products and coked catalyst. The hydrocarbon products of riser 1 are separated from the catalyst in the cyclone 8 and are passed through conduit 9 to be fed to distillation column 7. The hydrocarbon products are produced by catalytic cracking of the fresh hydrocarbon feed, of relatively poor crackability, entering through line 3 by the action of the spent catalyst entering from conduit 5, which both travel concurrently upwards through riser 1. The spent aluminosilicate catalyst reacts with the hydrocarbon in a manner producing relatively low conversion but relatively high gasoline selectivity. Therefore, the products separated in cyclone 8 from the coked catalyst comprises a mixed product of gasoline, LFO and HFO fractions, which are removed through conduit 9 to be fed to the distillation column 7. As with cyclone separator 4, at least one additional cyclone separator (not shown) may be used in combination with cyclone separator 8 to effect the separation of the coked catalyst from the hydrocarbon products. The coked catalyst separated from the products of riser 1 travel through conduit 10 into regenerating apparatus 11. Oxygen-containing regeneration gas is introduced by means (not shown) to a bottom portion of a dense fluid mass of catalyst in the regenerating apparatus 11 under conditions of temperature, pressure and space velocity to initiate combustion of carbonaceous material and raise the temperature of the mass of catalyst sufficient to substantially complete burning of deposited carbonaceous materials. Any of the known regenerating apparatus and/or gas for regenerating coked catalyst may be substituted for that shown. The hot regenerated catalyst being at an elevated temperature in excess of about 1000° F. and as high as 1400° or 1600° F., but typically about 1300° F., is withdrawn from a lower portion of regenerating apparatus 11 for distribution and use, as discussed below.

Distillation column 7 separates the products withdrawn from each of risers 1 and riser 2 into fractions, comprising, inter alia, a gasoline fraction which is withdrawn through conduit 12 and a HFO fraction which is withdrawn through conduit 13 for recycle to the inlet of riser 2. Other fractions may be drawn off at appropriate locations, such as naphtha, through conduit 17 or LFO through conduit 18. Still other fractions may be drawn off at locations (not shown), as is well known to those skilled in the art.

As can be seen in FIG. 1, the hot regenerated catalyst leaves regenerating apparatus 11 through conduit 14 for feeding to the inlet of riser 2. This catalyst is typically in excess of 1000° F., and as high as 1400° or 1600° F., and at such temperatures it will thus be appreciated that the cracking conditions in riser 2 are much more severe than those in riser 1, due in part to the temperature of the hot regenerated catalyst entering the inlet of riser 2, and in part to the relatively high proportion of HFO entering riser 2, which conditions cause further cracking of the HFO into gasoline plus LFO. As previously stated, the spent catalyst and products leaving riser 2 are separated in cyclone 4, with the spent catalyst being fed through conduit 5 to the inlet of riser 1 and the products of riser 2 exiting through conduit 6. It can thus be seen that a complete cycle has been described and the invention will be more particularly described with regard to the specific examples hereinbelow.

Figure 2:
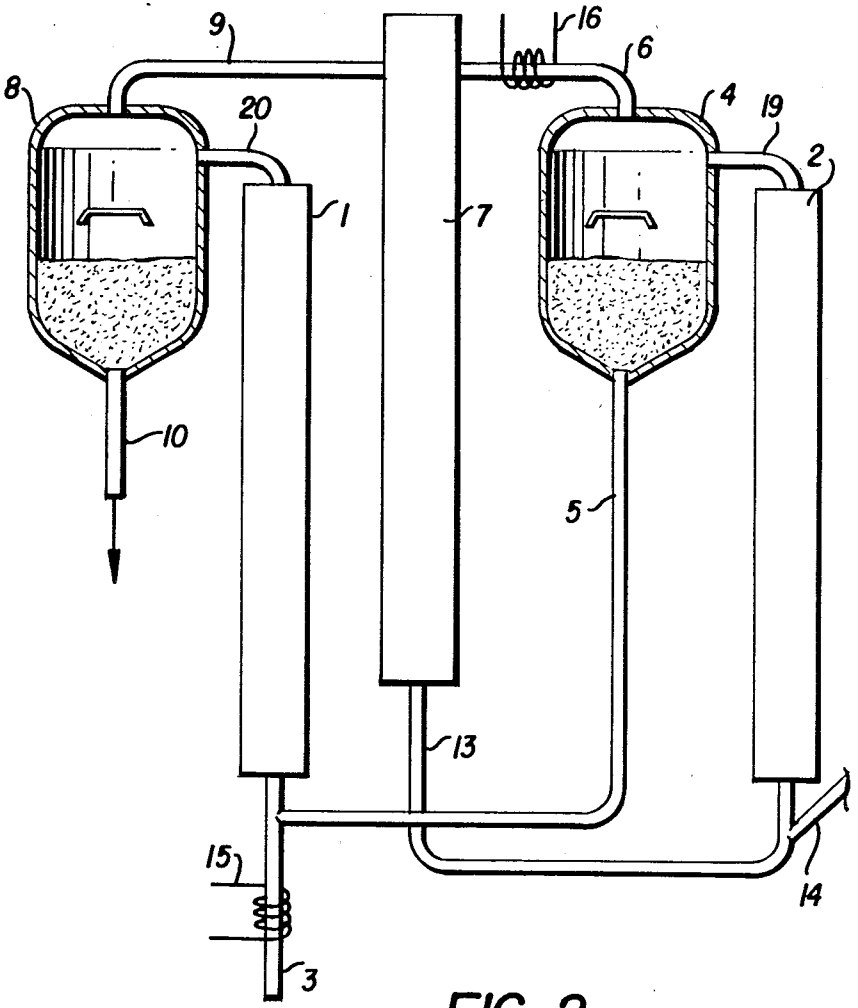
FIG. 2 is a schematic diagram of the two riser system of the present invention together with the distillation apparatus, including the means necessary to affect heat transfer.

The two riser system of the present invention produces higher yields of gasoline plus LFO than prior art processes. Turning now to FIG. 2, which is a schematic drawing of a typical two riser system of the present invention, it can be seen that riser 1 is fed through line 3 with fresh hydrocarbon feed at a feed temperature of about 740° F. If necessary, a heat exchange apparatus 15 provides heat to the fresh feed to raise the temperature thereof. This best may be provided from heat exchange apparatus 16 heated by the products of riser 2, or from some other source. Spent catalyst from riser 2 is fed through conduit means 5 to the inlet of riser 1. The temperature of the spent catalyst delivered from riser 2 may typically be about 1100° F., the same temperatures as the products of riser 2. The spent catalyst and fresh feed flow concurrently upward through riser 1, producing a temperature at the top of riser 1 at point 20 typically about 880° F. As previously discussed, the product and catalyst from riser 1 are separated by means of cyclone 8, with the temperature of the now coked catalyst being about 880° F. The product separated from the catalyst, also at about 880° F., proceeds through conduit 9 to distillation column 7. The coked catalyst recovered from cyclone 8 has a carbon-to-catalyst weight ratio $C_c$ (subscript represents coked ($_c$), regenerated ($_{reg}$) or spent ($_{sp}$) catalyst) of $C_c$=0.8%. This coked catalyst is fed to regenerating apparatus 11, wherein the catalyst is treated and removed from regenerator 11 at a temperature in excess of 1300° F., for example, 1319° F. The regenerated catalyst leaving the regenerating apparatus 11 is fed through conduit 14 to the inlet of riser 2. The regenerated catalyst has a $C_{reg}$=0.05%. At the inlet to riser 2 the regenerated catalyst is mixed with the recycle from distillation column 7, comprising a large percentage of HFO, at a temperature in excess of 700° F., i.e., 717° F. The recycle stream conveyed through conduit 13, comprising a high percentage of HFO, is mixed with the freshly regenerated catalyst from conduit 14, and is conveyed concurrently upward through riser 2. The conditions of cracking in riser 2 are much more severe than in riser 1, due in part to the freshly regenerated catalyst having a temperature in excess of 1300° F., such that the temperature at the top of riser 2 may be in excess of 1100° F. at point 19 just prior to separation of the catalyst from the products of riser 2 in cyclone 4. This spent catalyst from cyclone 4 is conveyed through conduit 5 to the inlet of riser 1, as previously described. The products removed from cyclone 4, also having a temperature in excess of 1100° F. at point 19, may be passed through heat exchanging apparatus 16 prior to entry into distillation column 7. Of course, the catalyst-to-oil (C/O) ratio may be adjusted by means known in the art to control the cracking in either riser 1 or riser 2 or both.

In all embodiments of the invention, the catalyst contacting the fresh hydrocarbon feed of relatively poor crackability 1 comprises a carbon content of which catalyst ($C_{sp}$) is greater than that of the regenerated catalyst ($C_{reg}$), but less than that of the coked catalyst ($C_c$) exiting the riser after contacting the fresh hydrocarbon feed.

In one embodiment, the spent catalyst fed to riser 1 is supplemented by regenerated catalyst feed directly from regenerator 11 or another source.

In a preferred embodiment of the invention, the spent catalyst exiting cyclone 4 may itself be partially regenerated prior to feeding to the inlet of riser 1. By partially regenerated is meant that a portion of the spent catalyst is regenrated and recombined with an unregenerated portion of spent catalyst to be fed to the inlet of riser 1 or, in the alternative, the spent catalyst is treated so as to regenerate the same to a carbon content less than it had but greater than that of the catalyst exiting regenerator 11, or a combination of both.

In the most preferred embodiment, the spent catalyst from cyclone separator 4 is fed, without treatment or mixing with regenerated or partially regenerated catalyst, into the inlet of riser 1. In other words, the spent catalyst of riser 2 separated by cyclone 4 is fed directly to the inlet of riser 1. Of course, conduit 5 is only schematic, and the integration of storage or mixing tanks (not shown) between cyclone separator 4 and the inlet of riser 1, operably connected to provide fluid communication between cyclone 4 and riser 1, is intended to be encompassed by the present disclosure.

As can be seen, the multiple riser system of the present invention offers flexibility with regard to heat exchange between various catalyst and liquid streams. Thus, hot catalyst from a regenerating apparatus 11 being conveyed through conduit 14 can be used to exchange heat by means (not shown) with the spent catalyst separated in cyclone 4 from the products of riser 2 as they are conveyed through conduit 5 back to riser 1. This heat exchange between regenerated catalyst and spent catalyst can be used to advantage, permitting higher top temperatures to be reached in riser 1, thus improving the conversion of fresh hydrocarbon feed to gasoline plus LFO. Since the spent catalyst from riser 2 being fed to riser 1 has a $C_{sp}$ of about 0.45%, it can be seen that raising the temperature of either the fresh feed by means of heat exchange through heat exchange apparatus 15 or increasing the temperature of the spent catalyst by heat exchange with the regenerated catalyst would increase the top temperature of riser 1 and improve the yield of gasoline plus LFO. Also, the hydrocarbon products exiting cyclone 4 through conduit 6 could be used as a source of heat for heat exchange apparatus 16.

As representative of the properties of the fresh hydrocarbon feed of poor crackability, note the properties in Table 1 for a typical feedstock.

TABLE 1

| Feed Properties | |
|---|---|
| API Gravity | 24.6 |
| MW of 650+ | 390 |
| MW of 650− | 233 |
| Wt % of 650+ | 97.0 |
| Wt % S in 650+ | 0.99 |
| Wt % S in 650− | 0.68 |
| Wt % Basic N | 0.033 |
| Paraffins in HFO | 25.83 |
| Naphthenes in HFO | 34.09 |
| CA in HFO | 16.55 |
| Paraffins in LFO | 30.14 |
| Naphthenes in LFO | 37.14 |
| CA in LFO | 17.6 |
| CCR | 0.21 |

The following examples are illustrative of the present invention.

EXAMPLES 1 AND 2

The advantages of the present invention will be seen by comparison of the present examples. Examples 1 and 2 represent the operating conditions and product yields in a single riser system. The single riser system utilizes a riser of 163 feet in height. In all the examples, the fresh hydrocarbon feed has the properties indicated in Table 1. The operating conditions and product yields in the single riser system for each of Examples 1 and 2 are given in Table 2.

TABLE 2

| Operating Conditions and Product Yields in Single Riser System | Example 1 | Example 2 |
|---|---|---|
| C/O Ratio | 4.0 | 4.0 |
| $T_{top}$, °F. | 960 | 880 |
| $T_{reg}$, °F. | 1300 | 1232 |
| Oil to Riser Temperature, °F. | 736 | 625 |
| Carbon on Catalyst, Inlet, wt % | 0.05 | 0.05 |
| Carbon on Catalyst, Spent, wt % | 0.68 | 0.7 |
| Product Yields on Feed Basis | | |
| Conversion, wt % | 62.8 | 57.3 |
| Gasoline, wt % | 46.90 | 45.04 |
| LFO, wt % | 16.98 | 16.95 |
| HFO, wt % | 20.19 | 25.77 |
| Coke, wt % | 3.37 | 3.5 |
| Dry Gas, wt % | 12.56 | 8.76 |
| G + D Yield | 63.88 | 62.0 |

As can be seen in Example 1, the gas plus distillate yield is 63.88%, while in Example 2 it is 62.0%. Note further that Example 1 has a $T_{top}$ temperature of 960° F., with the temperature of the regenerated catalyst fed to the inlet at a temperature of 1300° F.

EXAMPLE 3

A feed having the same properties as the feed identified in Table 1 was fed to the two riser system of the present invention. The two riser system of the present invention each comprise risers 45 feet in length. The operating conditions and product yields in the system of the present invention are shown in Table 3.

TABLE 3

| Operating Conditions and Product Yields in Two Riser System of Present Invention | Example 3 | |
|---|---|---|
| | Riser 1 | Riser 2 |
| C/O Ratio | 4.0 | 7.5 |
| $T_{top}$, °F. | 880 | 1100 |
| $T_{reg}$, °F. | 1100 | 1320 |
| Oil to Riser, °F. | 740 | 717 |
| Carbon on Catalyst, Inlet, wt % | 0.45 | 0.05 |
| Carbon on Catalyst, Spent, wt % | 0.80 | 0.45 |
| Product Yields (Basis) | Fresh Feed | HFO From Riser 1 |
| Conversion, wt % | 32.40 | 83.34 |
| Gasoline, wt % | 25.80 | 51.89 |
| LFO, wt % | 11.98 | 11.58 |
| HFO, wt % | 55.62 | 5.08 |
| Coke, wt % | 2.19 | 4.38 |
| Dry Gas, wt % | 4.41 | 27.07 |

It can be seen from a comparison of Table 3 that although the temperature of the regenerated catalyst was approximately the same as the 1300° F. of the single riser system in Example 1, the temperature $T_{top}$ at the top of riser 2 was 1100° F., greatly exceeding the $T_{top}$ of 960° F. of the single riser of Example 1. Therefore, much more severe conditions of cracking appeared in riser 2 than existed in the case of a single riser, as in Examples 1 and 2. Riser 1, which utilizes spent catalyst from riser 2 at an inlet temperature for the catalyst of 1100° F., has a temperature at the top of the riser of only 880° F. Such temperatures are indicative of mild cracking conditions. Although the mild cracking in riser 1 did not produce as much conversion as in riser 2, the selectivity to gasoline and LFO was much higher, as was the octane of the gasoline. Therefore, the combined yields from the two riser system of the present invention, as shown in Table 4, is much higher than the yield from a single riser system, even though the initial temperature of the regenerated catalyst fed to riser 2 in the system of the present invention is approximately the same as that fed to the single riser system of the prior art.

TABLE 4

| Combined Yields From Two Riser System of the Present Invention | |
|---|---|
| Conversion, wt % | 78.75 |
| Gasoline, wt % | 54.66 |
| LFO, wt % | 18.42 |
| HFO, wt % | 2.82 |
| Coke, wt % | 4.62 |
| Dry Gas, wt % | 19.46 |
| G + D Yield | 73.08 |

The dual riser system of the present invention was operated with both risers hot under the conditions shown in Table 5. As can be seen from the results tabulated in Table 6, the yield for gasoline plus distillate (G+D) was increased over the single riser system.

TABLE 5

| Dual Riser System of the Present Invention | Example 4 | |
|---|---|---|
| | Riser 1 | Riser 2 |
| C/O Ratio | 4.0 | 7.80 |
| $T_{top}$ | 960 | 960 |
| $T_{reg}$ | 1173 | 1206 |
| Oil to Riser | 850 | 525 |
| C on Inlet | 0.45 | 0.05 |
| C Spent | 0.79 | 0.47 |
| Product Yields | | |
| Conversion, Wt % | 36.86 | 74.0 |
| Gasoline, Wt % | 28.3 | 52.55 |
| LFO, Wt % | 12.14 | 15.09 |
| HFO, Wt % | 51.0 | 10.94 |
| Coke, Wt % | 2.08 | 4.73 |
| Dry Gas, Wt % | 6.48 | 16.72 |

TABLE 6

| Combined Yields From Two Riser System of the Present Invention | |
|---|---|
| Conversion | 74.6 |
| Gasoline | 55.10 |
| LFO | 19.83 |
| HFO | 5.58 |
| Coke | 4.49 |
| Dry Gas | 15.00 |
| G + D | 74.93 |

By way of comparison, applicants have defined the coefficient $K_c$ as the coke/crackability coefficient. This coefficient is an indication of coke selectivity and is utilized as a guide in varying the operating parameters of the process. For example, for the single riser system having the operating parameters found in Example 1 in Table 2, $K_c$ was equal to 1.99. For the two riser system of the present invention, as shown in Example 4, with the operating parameters as set forth in Table 5, $K_c$ was equal to 1.533. For the two riser system of the present invention, as set forth in Example 3, with the parameters tabulated in Table 3, $K_c$ equals 1.246. It can thus be seen that the system of the present invention reduces the production of coke, while improving the total yield of gasoline plus distillates.

Having thus provided a general discussion of the invention and specific examples in support thereof, it is to be understood that no undue limitations are to be imposed by reason thereof except as defined in the following claims.

We claim:

1. A method for converting hydrocarbons to gasoline in a two riser system, comprising:

contacting fresh hydrocarbon feed of poor crackability in a first riser with spent catalyst from a second riser to form cracked products and a coked catalyst;

withdrawing said cracked products from said first riser to separate a gasoline and a distillate fraction from a higher boiling point material;

regenerating the coked catalyst from the first riser;

feeding the higher boiling point material to said second riser;

feeding the regenerated catalyst to said second riser to further convert the high boiling point material into gasoline; and separating the spent catalyst from said second riser and feeding only said spent catalyst to said first riser.

2. The method of claim 1, including preheating the fresh hydrocarbon feed with heat from the two riser system.

3. The method of claim 1, further comprising the step of exchanging heat between said regenerated catalyst and said spent catalyst.

4. In a method of cracking hydrocarbons in a two-riser system, wherein cracked products are formed in a first riser from the contact of a fresh hydrocarbon feed of poor crackability with a catalyst, and wherein in a second riser of said two-riser system cracked products and a spent catalyst are formed from the contact of a hydrocarbon feed of better crackability than the feed to said first riser with a regenerated catalyst, the improvement comprising separating the spent catalyst from the cracked products formed in the second riser and feeding only said spent catalyst as the catalyst to said first riser.

* * * * *